United States Patent [19]

Kubisch

[11] Patent Number: 5,035,277

[45] Date of Patent: Jul. 30, 1991

[54] COUNTER GRAVITY CASTING APPARATUS

[75] Inventor: John G. Kubisch, Midland, Mich.

[73] Assignee: General Motors Corporation, Detroit, Mich.

[21] Appl. No.: 649,427

[22] Filed: Jan. 25, 1991

[51] Int. Cl.[5] ..... B22D 18/06

[52] U.S. Cl. ..... 164/255; 164/63; 164/323

[58] Field of Search ..... 164/255, 254, 256, 306, 164/309, 63, 339, 341, 137, 323

[56] References Cited

U.S. PATENT DOCUMENTS

| | | | |
|---|---|---|---|
| 4,340,108 | 7/1982 | Chandley et al. | 164/63 |
| 4,606,396 | 8/1986 | Chandley et al. | 164/255 |
| 4,616,691 | 10/1986 | Voss | 164/255 |
| 4,632,171 | 12/1986 | Almond | 164/255 |
| 4,658,880 | 4/1987 | Voss | 164/255 |
| 4,745,962 | 5/1988 | Mercer et al. | 164/255 |
| 4,825,933 | 5/1989 | Voss et al. | 164/255 |
| 4,828,011 | 5/1989 | Hafer et al. | 164/255 |
| 4,862,946 | 9/1989 | Chandley | 164/255 X |

*Primary Examiner*—J. Reed Batten, Jr.

*Attorney, Agent, or Firm*—Reising, Ethington, Barnard, Perry & Milton

[57] ABSTRACT

Casting apparatus comprises a vacuum box having a pair of laterally spaced side walls sealingly engaged to a pair of pick-up members disposed along laterally spaced apart sides of a casting mold. The vacuum box also comprises a pair of spaced end walls sealingly engaged to the casting mold. Sealing engagement of the laterally spaced vacuum box side walls to the pick-up members, rather than to the mold, permits a substantial reduction in the lateral dimension of the mold, thereby substantially reducing the amount of costly mold material (e.g., resin-bonded sand) needed to fabricate the mold for casting and to be disposed of after casting.

23 Claims, 2 Drawing Sheets

COUNTER GRAVITY CASTING APPARATUS

FIELD OF THE INVENTION

This invention relates to apparatus for the differential pressure, countergravity casting of a melt and, more particularly, to a mold/vacuum box/pick-up arrangement that allows the lateral dimension of the mold to be substantially reduced to reduce the amount of mold material required to fabricate the mold for casting and to be disposed of after casting as well as reduce the amount of mold material in contact with the melt for a corresponding reduction in the amount of slag generated.

BACKGROUND OF THE INVENTION

A vacuum-assisted, countergravity casting apparatus using a gas permeable mold is described in the Chandley et al U.S. Pat. No. 4,340,108 issued July 20, 1982 and U.S. Pat. No. 4,606,396 issued Aug. 19, 1986. Typically, the casting apparatus includes a casting mold having a porous, gas permeable upper mold member (cope) and a lower mold member (drag) sealingly secured together at a common horizontal parting plane, a vacuum box confronting the gas permeable upper mold member and means for immersing the underside of the lower mold member in an underlying pool of melt (e.g., molten metal) while evacuating the vacuum box to draw the melt upwardly through one or more ingate passages in the lower mold member into one or more mold cavities formed between the upper and lower mold members. Typically, the upper and lower mold members comprise gas permeable, resin-bonded sand mold members which are self-supporting and adhesively secured (glued) together at the common parting plane to minimize leakage of the melt at the parting plane.

The vacuum box typically rests on the lower mold member (mold drag) and includes a bottom lip carrying a sealing gasket adapted for sealingly engaging an upwardly facing sealing surface formed on the lower mold member about the mold cavity. The lateral dimension of the lower mold member must be large enough to accommodate the upwardly facing, vacuum box-engaging sealing surface thereon.

Moreover, the vacuum box and the mold are typically held together by some type of mechanical clamping arrangement to compress the sealing gasket between the vacuum box bottom lip and the mold sealing surface; for example, as shown in U.S. Pat. Nos. 4,340,108; 4,616,691; 4,632,171 and 4,658,880. In these clamping arrangements, the lower mold member (mold drag) oftentimes includes a plurality of relatively complex, pick-up features, such as threaded lugs, threaded bores, slotted keyways, counterbores and the like, for engagement with the clamping mechanism. The lateral dimension of the lower mold member must be large enough to accommodate these pick-up features thereon.

Finally, as disclosed in the U.S. Pat. No. 4,745,962 an upstanding levee may be formed on the lower mold member (mold drag) about the parting line with the upper mold member so as to isolate the parting line from the melt and allow deeper mold immersion during countergravity casting. Use of such an upstanding levee on the lower mold member requires that the lateral mold dimension be sufficient to accommodate such a levee thereon.

Use of these aforementioned vacuum box-to-mold seal, vacuum box-to-mold clamp and mold levee arrangements has necessitated that the lateral mold dimension, especially the lateral dimension of the mold drag, be greater than is actually needed to accommodate the mold cavity in the drag. As a result, relatively large mold drags have been used in practicing the countergravity casting process and require large amounts of costly mold-making material (e.g., resin-bonded sand) during mold fabrication and yield large amounts of used mold-making material which must be disposed of after casting. Moreover, an unnecessarily large mold surface is caused to contact the melt, thereby causing the formation of an unnecessarily large amount of slag.

It is an object of this invention to provide a countergravity casting apparatus including a unique casting mold/vacuum box/pick-up arrangement that provides the necessary sealing of the vacuum box about the mold and the necessary support of the mold throughout a casting cycle and that permits a substantial reduction in the lateral dimension of the mold to thereby reduce the amount of costly mold-making material (e.g., resin-bonded sand) needed to fabricate the mold for casting and to be disposed of after casting.

It is another object of the invention to provide a countergravity casting apparatus including a unique casting mold/vacuum box/pick-up arrangement wherein the vacuum box includes laterally spaced apart walls sealingly engaged to pick-up members disposed along laterally spaced apart sides of the mold so as to allow substantial reduction in the lateral dimension of the mold.

SUMMARY OF THE INVENTION

The invention contemplates a casting apparatus wherein a casting mold includes laterally spaced apart first and second sides defining a lateral mold dimension therebetween and first and second upwardly facing, spaced apart sealing surfaces extending between the mold sides proximate their opposite ends. A mold pick-up mechanism comprises first and second pick-up members supportively engaging the respective first and second mold sides and including respective first and second upwardly facing sealing surfaces thereon disposed outboard of the respective mold sides.

A vacuum box is adapted to sealingly engage the upwardly facing sealing surfaces of the mold and of the pick-up members. To this end, the vacuum box comprises a pair of laterally spaced apart first walls (e.g., side walls) overlying and sealingly engaged to the upwardly facing sealing surfaces on the pick-up members and a pair of spaced apart second walls (e.g., end walls) interconnecting the first walls and overlying and sealingly engaged to the upwardly facing sealing surfaces on the mold. Typically, the first walls of the vacuum box each include a lower lip sealingly engaged (via a sealing gasket) to the upwardly facing sealing surface of the pick-up members and the second walls each include a lower lip sealingly engaged (via a sealing gasket) to the upwardly facing sealing surfaces on the mold.

Since the laterally spaced apart first walls of the vacuum box are sealingly engaged to the pick-up members and not the mold, the lateral dimension of the mold (i.e., the dimension between the mold sides) does not need to be enlarged to accommodate engagement of the vacuum chamber thereon and instead can be reduced substantially to a minimum dimension needed only to accommodate a mold cavity therein. A substantial reduction in the amount of costly mold material (e.g., resin-bonded sand) required to fabricate the mold for casting and to be disposed of after casting is thereby achieved. The reduction in the lateral dimension of the mold reduces the surface area thereof in contact with the melt to reduce generation of slag.

In one embodiment of the invention, the upwardly facing sealing surfaces of the mold and the pick-up members are disposed in a common, generally horizontal plane to facilitate sealing engagement of the vacuum box therewith.

In another embodiment of the invention, each pick-up member includes an upwardly facing pick-up surface for sealingly and supportively engaging a respective downwardly facing pick-up surface on the mold sides via a sealing gasket therebetween.

In still another embodiment of the invention, the mold comprises a lower drag and an upper cope disposed atop the drag. The drag includes the downwardly facing pick-up surfaces extending along the laterally spaced apart sides thereof and the upwardly facing, spaced apart sealing surfaces extending across the opposite ends of the drag. The cope and drag preferably include a tongue and groove joint therebetween above each downwardly facing pick-up surface on the drag such that the upwardly facing pick-up surfaces on the pick-up members supportively engage the downwardly facing pick-up surfaces on the drag beneath the joints. The drag includes an underside of reduced lateral dimension extending below the pick-up members for immersion in an underlying pool of melt without the pick-up members having to contact the melt.

In still another embodiment of the invention, the pick-up members include upstanding guide members on which the vacuum box is relatively movably mounted for movement toward/away from the upwardly facing sealing surfaces of the mold and the pick-up members.

DETAILED DESCRIPTION OF THE INVENTION

Figure 1:
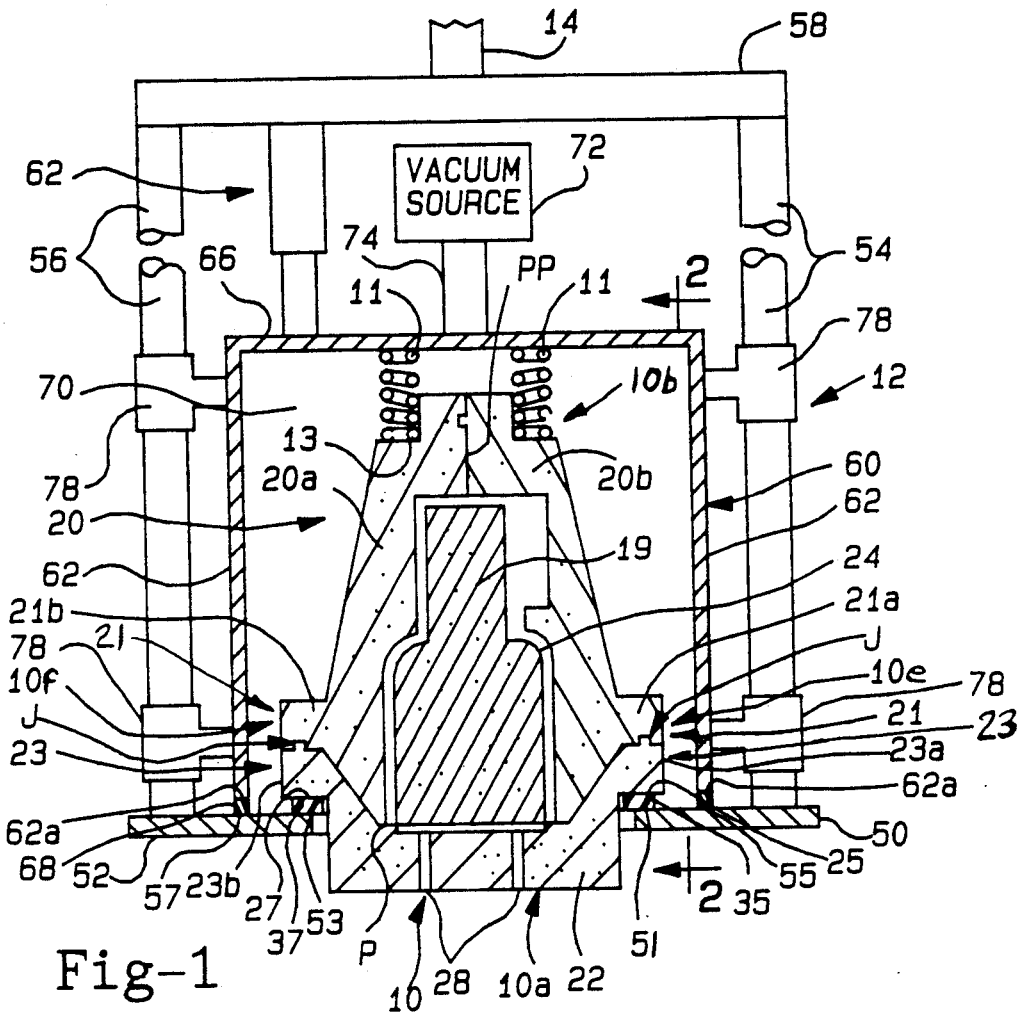
FIG. 1 is a sectioned, side view of a casting apparatus in accordance with one embodiment of the invention.
Figure 2:
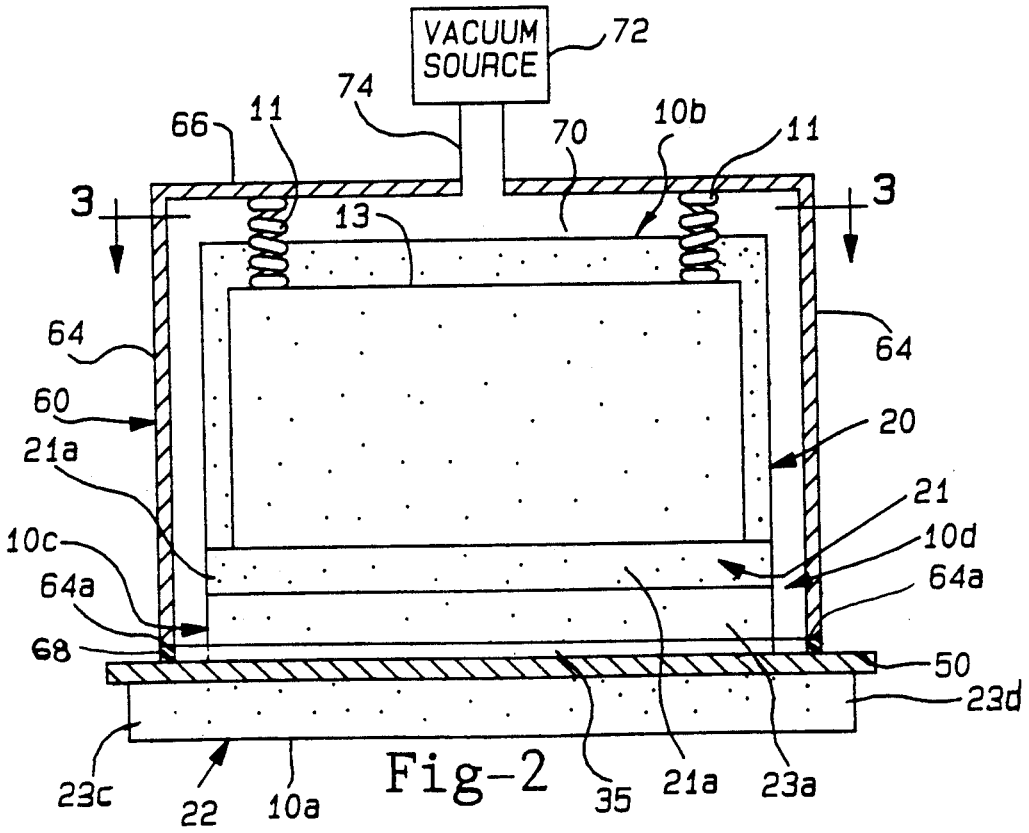
FIG. 2 is a sectioned view taken along lines 2—2 of FIG. 1.
Figure 3:
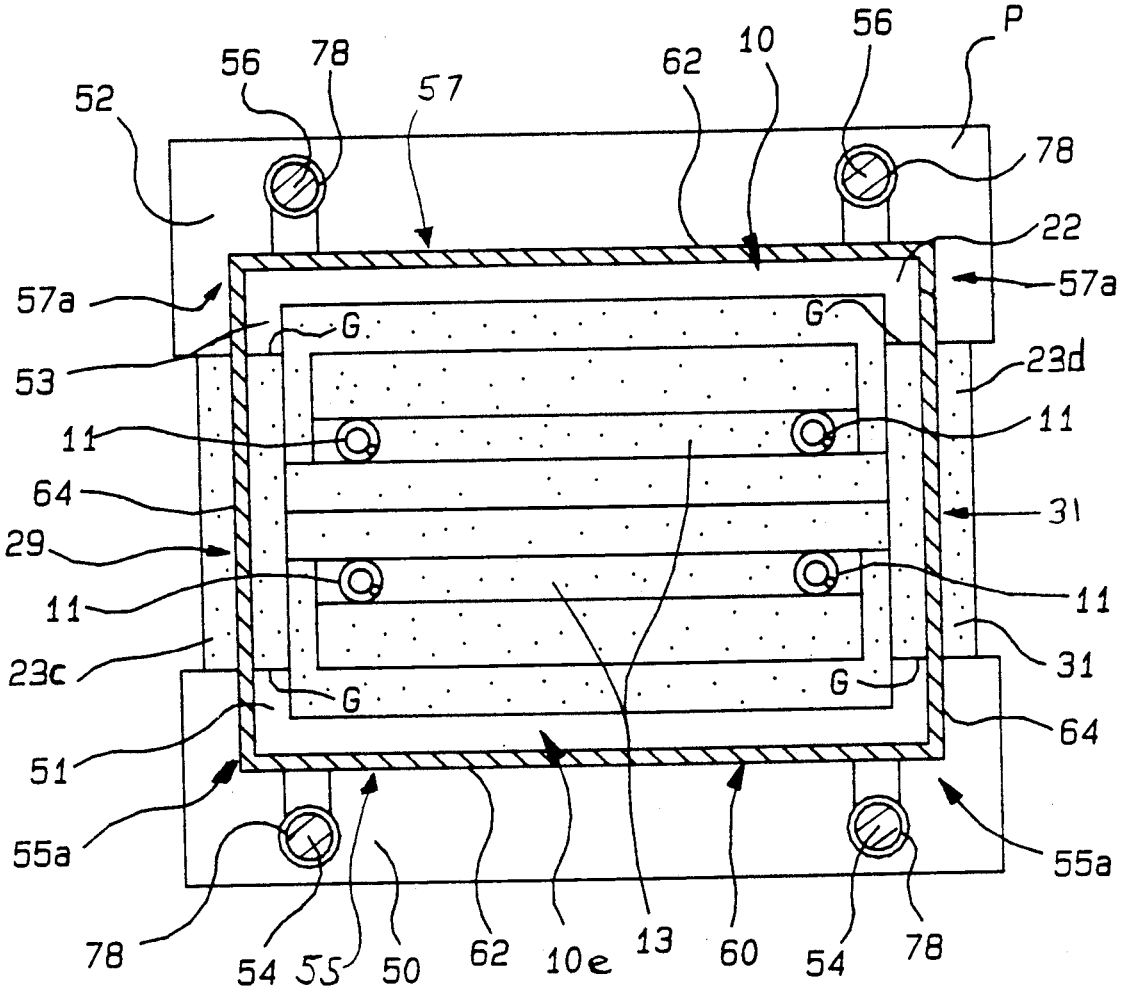
FIG. 3 is a sectioned view taken along lines 3—3 of FIG. 2.

FIGS. 1-3 illustrate one embodiment of a vacuum-assisted, countergravity casting apparatus of the invention. In particular, FIGS. 1-3 depict a casting mold 10 supported on a mold pick-up mechanism 12 which, in turn, is carried or mounted on a movable manipulating arm 14 (partially shown) of the type shown in the Chandley et al U.S. Pat. No. 4,340,108, the teachings of which are incorporated herein by reference. The manipulating arm 14 is adapted to transport the casting apparatus (i.e., mold 10 supported on the pick-up mechanism 12) to a casting station (not shown) where the mold underside 10*a* is immersed in an underlying pool of melt (e.g. molten metal) as shown, for example, in the aforesaid Chandley '108 patent. The manipulating arm 14 is actuated at the casting station to immerse the mold 10 in the melt for countergravity casting the melt upwardly into the mold 10, to withdraw the mold 10 from the melt after casting, and thereafter to transport the melt-filled mold 10 to a demold station (not shown) where the mold 10 and the pick-up mechanism 12 are disengaged to allow separation of the mold and the casting therein.

The casting mold 10 comprises a vertically-parted, gas permeable, upper mold cope 20 disposed atop a lower mold drag 22 at a lateral parting plane P. An optional core 19 is captured between the cope 20 and the drag 22 so as to form one or more mold cavities 24 therebetween (only one mold cavity shown). The mold cavity 24 is communicated via one or more ingate passages 28 in the drag 22 to the mold underside 10*a*. The mold (drag) underside 10*a* is adapted to be immersed in the underlying pool of melt during vacuum-assisted, countergravity casting as explained in the aforesaid Chandley '108 patent such that the melt is drawn upwardly through the ingate passages 28 into the mold cavity 24 to fill the mold cavity with the melt.

The vertically-parted sections 20*a*,20*b* of the cope 20 may be glued together at the vertical parting plane PP to minimize leakage of melt thereat. Similarly, the cope 20 and the drag 22 may be glued together at the lateral parting plane P or, alternately as shown, pressed sealingly together, sans glue, at the parting plane P by one or more springs 11 disposed between the vacuum box 60 and upwardly facing, elongated shoulders 13 formed in the top side 10*b* of the mold 10.

The cope 20 typically comprises a gas permeable material (e.g., resin-bonded sand) which permits gases to be withdrawn from the mold cavity 24 during countergravity casting. The drag 22 and optional core 19 may conveniently comprise the same material as the cope 20 or other materials, gas permeable or impermeable, which are compatible with the material of the cope 20.

The mold cope 20 and the mold drag 22 include respective first and second upstanding, laterally spaced apart sides 21,23 elongated between the front end 10*c* and the rear end 10*d* of the mold 10, as shown best in FIG. 2. The cope sides 21 and drag sides 23 each include laterally extending ledges 21*a*,21*b*; 23*a*,23*b* that are configured to define tongue and groove joints J therebetween at the parting plane P. The cope/drag sides 21,23 define laterally spaced apart mold sides 10*e*,10*f* defining a lateral dimension of the mold therebetween.

The ledges 23*a*,23*b* on the mold drag 22 include downwardly facing, generally horizontal pick-up surfaces 25,27 on the opposite mold sides 10*e*,10*f*. The pick-up surfaces 25,27 are elongated between the front end 10*c* and the rear end 10*d* of the mold 10 and are adapted to be supportively engaged by the pick-up mechanism 12 via elongated sealing gaskets 35,37 located beneath each pick-up surface 25,27.

The ledges 23*a*,23*b* are spaced above the mold underside 10*a* to provide enough space for engagement by the mold pick-up mechanism 12 and yet leave a mold immersion zone for immersion in the melt during casting without risking contact of the pick-up mechanism 12 with the melt. As best shown in FIG. 1, the lower portion of the drag 22 extends below the pick-up mechanism 12 for immersion of the mold underside 10*a* in the pool of melt.

As shown in FIG. 3, the mold drag 22 also includes first and second upwardly facing, generally horizontal sealing surfaces 29,31 disposed between the mold sides 10*e*,10*f* (i.e., across the opposite ends 10*c*,10*d* thereof). The sealing surfaces 29,31 are formed on drag end extensions 23*c*,23*d* that protrude beyond the ledges 23*a*,23*b* at the mold front end 10*c* and the mold rear end 10*d*. The drag sealing surfaces 29,31 are adapted to sealing engage the vacuum box 60.

The cope 20 and the drag 22 as well as optional core 19 typically are each made in accordance with known mold practice where a compliant (shapeable) mixture of sand or equivalent particles and a settable binder material (e.g., an inorganic or organic thermal or chemical setting plastic resin) is formed to shape and then cured or hardened against a respective contoured pattern plates (not shown) to form the various mold features illustrated in the figures, including the ledges 21*a*,21*b*;-23*a*,23*b* on the cope 20 and the drag 22. The ledges are relatively simple in configuration and can be readily formed using such known mold practices.

Referring to FIGS. 1–3, the mold pick-up mechanism 12 comprises first and second pick-up members 50,52 positioned along the respective first and second mold sides 10*e*,10*f*, a pair of upstanding guide members 54,56 mounted on each pick-up member 50,52, and a support frame 58 (shown schematically) connecting the guide members to the manipulating arm 14. A vacuum box 60 is movably mounted on the guide members 54,56 so as to overlie both the mold drag 22 and the pick-up members 50,52. The vacuum box 60 is movable vertically on the guide members 54,56 toward/away from the mold drag 22 and the pick-up members 50,52 by actuator means 62 (shown schematically), such as a fluid cylinder connected between the frame 58 and the vacuum box top 66.

The pick-up members 50,52 comprise generally horizontal plates that are elongated along the mold sides 10*e*,10*f* and are spaced laterally apart to accommodate the lower portion of the mold drag 22 therebetween while engaging the mold pick-up surfaces 25,27 as shown in FIG. 1. The pick-up members 50,52 each include an upwardly facing, inboard pick-up surface 51,53 and an upwardly facing sealing surface 55,57 disposed outboard of the pick-up surfaces 51,53. As shown in FIGS. 1 and 3, the sealing surfaces 55,57 are disposed outboard of the mold sides 10*e*,10*f* so as to underlie the vacuum box 60 and be sealingly engageable therewith. As is apparent from FIG. 1, the pick-up surfaces 51,53 and sealing surfaces 55,57 are formed on the same (common) upwardly facing surface of each pick-up member 50,52 but at different lateral locations thereon. The pick-up surfaces 51,53 and sealing surfaces 55,57 are thereby rendered coplanar with one another in a common horizontal plane. Also, the pick-up members 50,52 are positioned relative to the mold 10 such that the sealing surfaces 55,57 are coplanar with the drag sealing surfaces 29,31. Orientation of the pick-up and sealing surfaces in this manner facilitates engagement of the mold 10, pick-up mechanism 12 and vacuum box 60.

As shown best in FIG. 1, the inboard pick-up surfaces 51,53 sealingly and supportively engage the mold drag pick-up surfaces 25,27 via the sealing gaskets 35,37 which typically are carried on the pick-up surfaces 51,53, although they could be attached to the drag pick-up surfaces 25,27. The outboard sealing surfaces 55,57 are adapted to sealingly engage the vacuum box 60 in a manner to be described.

In particular, the vacuum box 60 includes a pair of laterally spaced apart first (side) walls 62 and a pair of spaced apart second (end) walls 64 that interconnect the first (side) walls and define a vacuum chamber 70 confronting the casting mold 10 as shown best in FIGS. 1 and 2. The first (side) walls 62 overlie and sealingly engage the upwardly facing sealing surfaces 55,57 on the pick-up members 50,52. The second (end) walls 64 overlie and sealingly engage the upwardly facing sealing surfaces 29,31 on the drag 22.

The vacuum chamber 70 is connectable to a source of reduced pressure 72, such as a vacuum pump, via a conduit 74 extending from the top side 66 of the vacuum box 60. The vacuum chamber 70 is evacuated sufficiently to draw the melt upwardly into the mold cavity 24 when the mold underside 10*a* is immersed therein.

Each side wall 62 of the vacuum box includes a pair of upper and lower sleeves 78 for receiving the guide members 54,56 extending upwardly from the pick-up members 50,52. The top side 66 of the vacuum box is connected to the actuator means 62, for moving the vacuum box vertically on the guide members 54,56 toward/away from the underlying mold and pick-up members.

The first (side) walls 62 and the second (end) walls 64 of the vacuum box 60 include respective lower lips 62*a*,64*a* that include a sealing gasket 68 thereon. The gasket 68 is adapted to sealingly engage the sealing surfaces 55,57 on the pick-up members and the sealing surfaces 29,31 on the drag 22 such that the vacuum chamber 70 sealingly confronts the mold 10 above the pick-up members 50,52. The sealing gasket 68 may comprise reusable sections or lengths carried on lips 62*a* for engaging the sealing surfaces 55,57 and disposable sections or lengths on lips 64*a* for engaging the drag sealing surfaces 29,31.

Referring to FIG. 1, it is apparent that the first (side) walls 62 of the vacuum box 60 are sealingly engaged (via gasket 68) to the sealing surfaces 55,57 of the pick-up members and not to any sealing surface on the mold drag 22. As a result, the lateral dimension of the mold 10 (i.e., drag 22) does not need to extend beneath the side walls 62 since these walls 62 seal on the sealing surfaces 55,57 of the pick-up members. Consequently, the lateral dimension of the mold 10 (i.e., drag 22) can be selected at a minimum dimension as needed only to accommodate the mold cavity 24 of the mold 10. In effect, the lateral mold dimension can be substantially reduced (as compared to prior art molds where the vacuum box side walls seal on the drag) so as to substantially reduce the amount of costly resin-bonded sand employed to fabricate the mold for casting and to be disposed of after casting. Moreover, the reduced lateral dimension of the mold drag 22 exposes less resin-bonded sand to the melt during countergravity casting when the mold drag 22 is immersed therein so as to reduce the amount of slag (oxide and ceramic particles) generated in the melt during countergravity casting.

In operation of the casting apparatus of FIGS. 1–3, the assembled casting mold 10 is rolled or lifted to position it over the pick-up mechanism 12 with the mold drag pick-up surfaces 25,27 spaced above the pick-up surfaces 51,53 of the pick-up members 50,52. The pick-up mechanism 12 is then raised by the manipulating arm 14 to sealingly and supportively engage the pick-up surfaces 25,27; 51,53 via the gaskets 35,37 as shown best in FIG. 1. The vacuum box 60 is then lowered along guide members 54,56 by actuator means 62 to sealingly engage via gasket 68 to both the mold drag 22 and the pick-up members 50,52. In particular, the bottom lip 62*a* of each first (side) wall 62 sealingly engages the underlying sealing surface 55,57 on the pick-up members 50,52. The bottom lip 64*a* of each second (end) wall 64 sealingly engages via gasket 68 the underlying sealing surface 29,31 of the mold drag 22 adjacent the mold front end and rear end 10*c*,10*d* and corner portions 55*a*,57*a* of each sealing surface 55,57 of the pick-up members as best shown in FIG. 3. Small gaps G may be present between the pick-up members 50,52 and the mold drag 22 inside the vacuum chamber 70 (FIG. 3) but are typically small enough so as not to adversely affect establishment of a required vacuum level in the vacuum chamber for countergravity casting. Alternately, the gaps G can be sealed with a suitable material or gasket (not shown).

After the mold 10 and the pick-up mechanism 12 are operatively engaged as shown in the figures, the manipulating arm 14 is actuated to transport the mold-/vacuum box/pick-up mechanism to the casting station (not shown) where the mold underside 10*a* is immersed in the melt and a sufficient vacuum is established in the vacuum chamber 70 to draw the melt upwardly through the ingate passages 28 into the mold cavity 14 to fill it with the melt. After initial solidification of the melt in the ingate passages 28, the manipulating arm 14 is actuated to raise the mold underside 10*a* out of the melt and transport the mold/vacuum box/pick-up mechanism to the demold station (not shown). At the demold station, the manipulating arm 14 is actuated to place the mold 10 on a horizontal shake-out grate. The vacuum box 60 is raised along the guide members 54,56 above the mold 10 and the pick-up mechanism 12 is then lowered (by arm 14) to position the pick-up surfaces 51,53 spaced below the drag pick-up surfaces 25,27 so that the mold 10 can be separated from the pick-up mechanism 12. The pick-up mechanism 12 can then be engaged to another casting mold 12 to repeat the casting cycle for the new mold.

While the invention has been described in terms of specific embodiments thereof, it is not intended to be limited thereto but rather only to the extent set forth hereafter in the following claims.

I claim:

1. Casting apparatus, comprising:

a) a casting mold having laterally spaced apart first and second sides and first and second upwardly facing, spaced apart sealing surfaces between said first and second sides, b) a mold pick-up mechanism comprising first and second pick-up members supportively engaging the respective first and second sides of the mold, said first and second pick-up members each having an upwardly facing sealing surface disposed outboard of the respective first and second mold sides, and c) a vacuum box having a pair of laterally spaced apart first walls overlying and sealingly engaged to the upwardly facing sealing surfaces on the pick-up members and a pair of spaced apart second walls interconnecting said first walls and overlying and sealingly engaged to the upwardly facing sealing surfaces on the mold.

2. The apparatus of claim 1 wherein the first walls each have a lower lip sealingly engaged to a said upwardly facing sealing surface on the pick-up members and said second walls each have a lower lip sealingly engaged to a said upwardly facing sealing surface on the mold.

3. The apparatus of claim 2 wherein the lower lips of said first walls and said second walls include a sealing gasket thereon for sealingly engaging said walls to the upwardly facing sealing surfaces on said pick-up members and said mold.

4. The apparatus of claim 3 wherein the sealing gasket on each lower lip of said first walls comprises a reusable gasket.

5. The casting apparatus of claim 1 wherein the vacuum box is relatively movably mounted on the pick-up mechanism for movement toward/away from the mold and pick-up members.

6. The casting apparatus of claim 5 wherein the first and second pick-up members each include an upstanding guide member and said vacuum box is guidingly mounted on said guide members.

7. The apparatus of claim 6 wherein each first wall of the vacuum box includes a sleeve slidably receiving a said guide member.

8. The apparatus of claim 1 wherein the mold comprises a lower drag and an upper cope disposed atop the drag, said drag including downwardly facing pick-up surfaces on said laterally spaced apart sides thereof and said upwardly facing sealing surfaces extending across opposite ends of said drag.

9. The apparatus of claim 8 wherein said drag includes an underside disposed below said pick-up members for immersion in an underlying pool of melt.

10. The apparatus of claim 8 wherein the cope and the drag include a tongue and groove joint along said laterally spaced apart sides above each downwardly facing pick-up surface such that each pick-up member supportively engages a said downwardly facing pick-up surface beneath each said joint.

11. The apparatus of claim 1 including a sealing gasket between each downwardly facing pick-up surface of said mold and each pick-up member.

12. The apparatus of claim 1 wherein the upwardly facing sealing surfaces on said mold and said pick-up members are generally horizontally oriented in a common plane.

13. Casting apparatus, comprising:

a) a casting mold having laterally spaced apart first and second sides, first and second downwardly facing pick-up surfaces on the respective first and second sides, and first and second upwardly facing, spaced apart sealing surfaces between said first and second sides, b) a mold pick-up mechanism comprising first and second pick-up members disposed along the respective first and second mold sides, said first and second pick-up members each having an upwardly facing, pick-up surface supportively engaging a said downwardly facing pick-up surface on said mold sides and an upwardly facing sealing surface outboard of the pick-up surface, and c) a vacuum box having a pair of laterally spaced apart first walls overlying and sealingly engaged to the upwardly facing sealing surfaces on the pick-up members and a pair of spaced apart second walls interconnecting said first walls and overlying and sealingly engaged to the upwardly facing sealing surfaces on the mold.

14. The apparatus of claim 13 wherein the first walls each have a lower lip sealingly engaged to a said upwardly facing sealing surface on the pick-up members and said second walls each have a lower lip sealingly engaged to a said upwardly facing sealing surface on said mold.

15. The apparatus of claim 14 wherein the lower lips of said first walls and said second walls include a sealing gasket thereon for sealingly engaging said walls to the upwardly facing sealing surfaces on said pick-up members and said mold.

16. The apparatus of claim 15 wherein the sealing gasket on each lower lip of said first walls comprises a reusable gasket.

17. The casting apparatus of claim 14 wherein the vacuum box is relatively movably mounted on the pick-up mechanism for movement toward/away from the mold and the pick-up members.

18. The casting apparatus of claim 17 wherein the first and second pick-up members each include an upstanding guide member and said vacuum box is guidingly mounted on said guide members.

19. The apparatus of claim 18 wherein each second wall of the vacuum box includes a sleeve slidably receiving a said guide member.

20. The apparatus of claim 14 wherein said mold includes an underside disposed below said pick-up members for immersion in an underlying pool.

21. The apparatus of claim 14 including a sealing gasket between each downwardly facing pick-up surface of said mold and each upwardly facing pick-up surface of said pick-up members.

22. The apparatus of claim 14 wherein the upwardly facing sealing surfaces on said mold and said pick-up members are generally horizontally oriented in a common plane.

23. Casting apparatus, comprising:

a) a resin-bonded sand casting mold comprising a lower drag and an upper cope disposed atop the drag, said drag having laterally spaced apart sides, first and second laterally extending ledges on said sides, each ledge having a downwardly facing, generally horizontal pick-up surface, and first and second upwardly facing, generally horizontal, spaced apart sealing surfaces between said sides proximate opposite ends thereof, b) a mold pick-up mechanism comprising first and second pick-up members disposed along the respective first and second mold sides, said first and second pick-up members each having an upwardly facing, generally horizontal pick-up surface supportively engaging a said downwardly facing pick-up surface on said ledges and an upwardly facing, generally horizontal sealing surface outboard of the pick-up surface, and c) a vacuum box having a pair of spaced apart first walls overlying and sealingly engaged to the upwardly facing sealing surfaces on said pick-up members and a pair of spaced apart second walls interconnecting said first walls and overlying and sealingly engaged to the upwardly facing sealing surfaces on the mold.

* * * * *